US007156490B2

(12) United States Patent
Ginskey

(10) Patent No.: US 7,156,490 B2
(45) Date of Patent: Jan. 2, 2007

(54) CLIP FOR PURGING AND REFILLING INKJET CARTRIDGES

(75) Inventor: David R. Ginskey, Wichita, KS (US)

(73) Assignee: Stratitec, Inc., Wichita, KS (US)

( * ) Notice: Subject to any disclaimer, the term of this patent is extended or adjusted under 35 U.S.C. 154(b) by 264 days.

(21) Appl. No.: 10/821,039

(22) Filed: Apr. 7, 2004

(65) Prior Publication Data

US 2005/0225610 A1 Oct. 13, 2005

(51) Int. Cl.
*B41J 2/14* (2006.01)

(52) U.S. Cl. ..... 347/49

(58) Field of Classification Search ..... 347/29, 347/30, 49, 85

See application file for complete search history.

(56) References Cited

U.S. PATENT DOCUMENTS 5,199,470 A 4/1993 Goldman
5,515,663 A 5/1996 Allgeier, Sr. et al.
6,142,601 A * 11/2000 Sharma et al. ..... 347/28
6,172,695 B1 * 1/2001 Liu ..... 347/85
6,390,613 B1 * 5/2002 Liu ..... 347/85
6,793,317 B1 * 9/2004 Shima ..... 347/29

* cited by examiner

*Primary Examiner*—Anh T. N. Vo
(74) *Attorney, Agent, or Firm*—Lathrop & Gage LC

(57) ABSTRACT

Disclosed is a clip for holding an inkjet cartridge for the duel purposes of either refilling it with ink, or suctioning out the ports on the cartridge's printhead. The clip has an overhang with a depending portion which helps hold the cartridge in place. The clip also has a horizontally-extending portion having a wavy cross-section. The wavy cross-sectional configuration gives the clip its desired flexibility while maintaining good retention of the cartridge.

6 Claims, 2 Drawing Sheets

CLIP FOR PURGING AND REFILLING INKJET CARTRIDGES

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The device of the present invention relates generally to the field of refilling inkjet cartridges. More specifically, the device of the present invention is a clip that is used to secure an inkjet cartridge so that it may be refilled (or purged). The device may be used to refill an inkjet cartridge by back-flowing ink, under pressure, into the cartridge through the ports on its printhead. The device may also be used to purge a cartridge's printhead by suctioning ink out through it's ports.

2. Description of the Related Art

There are several commercially-available varieties of computer printers. Some use thermal heads. Others use lasers. Perhaps the most common sort of printer, however, uses ink jets.

These inkjet printers are very popular because they may be purchased at relatively low cost. Maintenance on inkjet printers may be expensive, however. The print head and ink container for an inkjet printer are typically included in a disposable unit. These disposable units may be very expensive. In some cases, such a cartridge may be good for printing less than 500 sheets of paper, and cost more than a fourth of the purchase price for the printer in which they are to be used. Considering this, the user may quickly incur maintenance costs which exceed the initial expense for the entire printer.

One reason for the high cost per cartridge is that a new print head is included with each unit. This print head has a useful life multiple times longer than the length of time provided by the ink included. Therefore, when a cartridge is discarded after running out of ink, a still-good cartridge and print head are wasted.

The problem is increased where color cartridges are concerned. Color cartridges typically have three separate color reservoirs. One for each of three primary colors. These colors will tend to run out at different rates. When the first of the three runs out, the user may throw out significant quantities of unused ink in the other two reservoirs.

The manufacturers of these cartridges have not provided the consumer with a way to replenish the ink within these cartridges, or even develop an alternative design in which does not require disposal of the cartridge. Instead, the manufacturers have created a cartridge that is difficult to refill. Thus, there is a great need in the art for methods and devices for refilling spent inkjet cartridges.

Devices exist in the prior art which may be used to refill inkjet cartridges. Syringes have been used. In such cases, a needle is mounted on a syringe. The needle is then dipped in a vial from which ink is drawn. The ink is then injected into an inkjet cartridge by inserting the needle into it and injecting the ink into the cartridges ink reservoir. One example showing this is U.S. Pat. No. 5,515,663 issued to Allgeier, Sr., et al. Allgeier shows the use of a syringe to deliver ink to a cartridge. U.S. Pat. No. 5,199,470 issued to Goldman shows a similar arrangement, except using a needle on a squeeze bottle instead of a syringe.

Clips have been used in the prior art. These clips are used to secure an inkjet cartridge. Once the cartridge is secured, it may be refilled by introducing ink, under pressure, through the ports in the cartridge's printhead. This prior art clip comes with a rubber member. This rubber member engages the printhead and fluidly seals it. This prior art clip also comes with an vertical wall and a horizontally extending wall.

An example of this type of prior art clip may be seen in FIG. 6. Referring to the figure, it may be seen that the clip 110 has upright 120 and horizontal 118 extending sections. Upright member 120 has a recessed rectangular area (not shown) which includes a square aperture (not shown). The square aperture receives a stem 164 on a rubber gasket device 112. Gasket 112 includes a conduit The conduit allows the fluid communication of ink from a syringe (not shown) through the ports on a printhead on an inkjet cartridge (like cartridge 14 disclosed in FIG. 4) for introducing ink into the cartridge via the cartridge's ink ports. This is the known conventional use for the clip 110.

The use of clip 110 for refilling has proved to have its limitations, however. One problem is that the cartridge is difficult to lock in to the clip 110. This is because the horizontally extending portion 118 is very rigid. This rigidity is necessary because once the cartridge is snapped into the clip using a latching assembly 150,152, its printhead must be pressed tightly into gasket 112. Otherwise, the printhead might move, creating problems.

One other problem with clip 110 is that it is sometimes difficult to ensure that its printhead is matched up and held in fluid communication with the conduit (not shown) through gasket 12. This is because, though the printhead on the cartridge is supported from below by the horizontal member 118, there is nothing to retain the top of the cartridges printhead from above. This may create matchup problems with the conduit and printhead ports. It also makes the cartridge more likely to pop out of the clip. If the cartridge comes out of the clip during the refilling process, a mess could be created. Inkjet ink stains horribly, and is impossible to remove from most materials or surfaces.

Therefore, there is a need in the art for a device and method which involves holding the print head portion of the cartridge securely in the clip, in which the cartridge may be easily clipped and unclipped from the device.

Another need in the art, aside from the need to enable refilling, as already discussed, is to enable the effective unclogging of the ports of a used cartridge. Most inkjet cartridges have a number of orifices at their bottom. These holes are very small, and comprise the ink outlets for the cartridge. The outlets will typically work in one of two ways.

The first type of inkjet technology, called bubble jet, uses thermal energy. In a bubble-jet arrangement, resistors are used to heat the ink and vaporize it. A vaporous bubble is thus created. As this bubble expands, some of the ink is pushed out of the outlets on the printhead at high velocity and accuracy onto the paper. The bubble then pops. This collapse creates a vacuum that serves to pull more ink into the printhead from the cartridge to be heated.

The second method of ink dispersal uses piezoelectric crystals. These crystals are located behind the ink reservoir behind each outlet. A tiny charge is delivered to the crystals that causes them to vibrate. Inward vibrations of these crystals forces ink out through the outlets onto the paper.

Both the thermal and piezoelectric methods are very harsh ways to eject the ink from the outlet ports. Thus, the outlets may degrade, and oftentimes become clogged. Therefore, there is a need in the art for an effective method to purge impurities and clogs in the ports in a manner that enables the cartridge to be held securely while its ports are suctioned clean of debris.

SUMMARY OF THE INVENTION

The method and devices of the present invention overcome the deficiencies present in the prior art methods of refilling ink cartridges. Used is a clipping device. The clip secures an inkjet cartridge. The clip has a laterally extending member and an upright member. The upright member is adapted to receive a stem from a gasket through an aperture made there through. One end of the stem is connected to a mat portion of the gasket. The mat is pressed against an inside face of the upright member. A fluid transmission circuit is defined by a conduit. The conduit fluidly communicates with an aperture which is defined within the mat.

Also included is a releasable latching mechanism at a distal end of the laterally extending member. The latching mechanism serves to lock down the outer end of the inkjet cartridge.

An overhang portion is included on the upright member. It has a downwardly depending portion which engages an outcropped portion of said cartridge to hold down the end of the cartridge on which the printhead is disposed.

The laterally extending member has a cross section having two waves. This helps the laterally extending member to have the desired flexibility enabling it to function properly.

Also disclosed is a method of using the device to clean out the ports of a printhead of a cartridge. This is done by receiving the cartridge in the clip, including a sealing gasket in the clip for fluidly connecting the ports to a pressure controlling device through a conduit, and administering suction to the ports using said pressure controlling device to clean them out.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

An embodiment of the present invention is shown in FIGS. 1–5.

Figure 1:
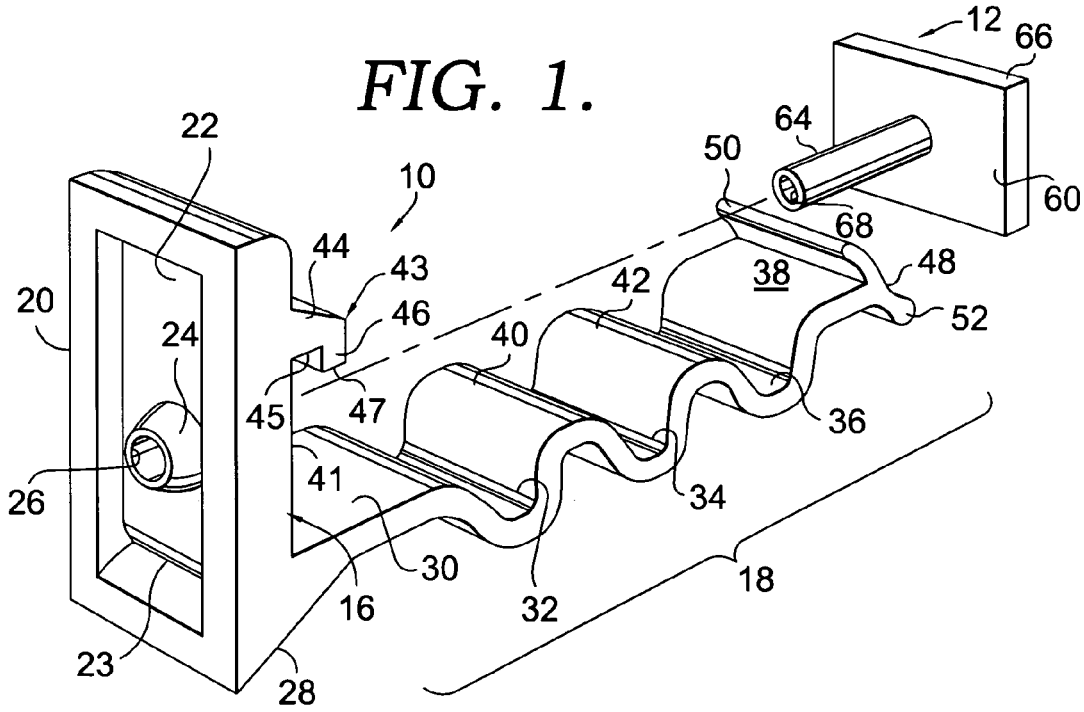
FIG. 1 is a perspective view of the clip and rubber gasket of the present invention.

Referring first to FIG. 1, we see a perspective view of the device of the present invention with its parts disassembled for illustrative purposes. Referring to this exploded view drawing, we see that the clip 10 comprises essentially two pieces. The first part is an L-shaped clip 10. The second is a rubber filling/purging gasket 12.

Clip 10 is comprised of thermoplastic material in the preferred embodiment, but may be comprised of other materials which would still fall within the scope of the present invention. A flexible thermoplastic material has been selected here, because it maintains significant rigidity while at the same time permitting a certain amount of flex, which is important to the present invention, and will be discussed in more detail later.

As the name suggests, rubber gasket 12 is comprised entirely of rubber. Rubber is used for several reasons. First, rubber has excellent sealing properties as will be evident from its selection for use in rubber gaskets and other such instances in which it's necessary to form a flexible meshed seal which is impermeable to water or other fluids. A second reason is its superb flexibility while at the same time being durable. The flexibility of rubber is, for one reason, useful here in making the gasket 12 easily insertable into clip 10, as will be described hereinafter.

We will first discuss the physical features of clip 10. These may be seen in FIGS. 1–3. Starting at the left hand side of each of the illustrations, we see that the clip has an upright portion 16 and a laterally extending portion 18. Upright portion 16 has a back side 20. On backside 20 is a rectangular recess. At the bottom of recess 22 is an indented bottom 23 which juts slightly inward. Recess 22 along with indented bottom 23 are provided simply to save material for purposes of production. Included within recess portion 22 is a hemispherical outcropping 24. Hemispherical outcropping 24 will be used to receive, and structurally support a stem 64 of rubber gasket 12, as will be described hereinafter. Hemispherical outcropping 24 defines at its central axis a stem receiving hole 26. Hole 26 which accommodates said stem 64. On a forward side and bottom of upright portion 16 is an upwardly angled portion 28 which rises to meet the laterally extending portion 18 of clip 10. Laterally extending arm 18 is significantly longer than upright portion 16. It has the same width as upright portion 16, but is relatively thin and long.

It has an irregular cross sectional shape. This may best be seen in FIGS. 2 and 3. This shape begins with an inner most plateau 30, which is followed by a plurality of valleys. Of this plurality, a first valley 32 is the result of a drop off from plateau 30. First valley 32 then rises to a first crest 40. Crest 40 then drops off into a second valley 34. This valley 34 then rises to a second crest 42. Second crest 42 then drops off to form a third valley 36. Third crest 36 then rises to an outer most plateau 38 which is substantially at the end (out most part) of laterally extending portion 18.

The crest and valley configuration of clip 10 results in the device having a wavy cross-section. The wavy cross-sectional configuration gives the clip its desired flexibility while maintaining good retention of the cartridge.

At the very tip of laterally extending portion 18 and joined with plateau portion 38 is a thumb-activated release mechanism 48. Thumb-activated release mechanism 48 comprises upper and lower parts. The upward part is an upwardly projecting locking portion 50. The lower part is a downwardly depending trigger portion 52. Mechanism 48 will be used to clip in and release a cartridge 14 as will be described hereinafter.

Figure 4:
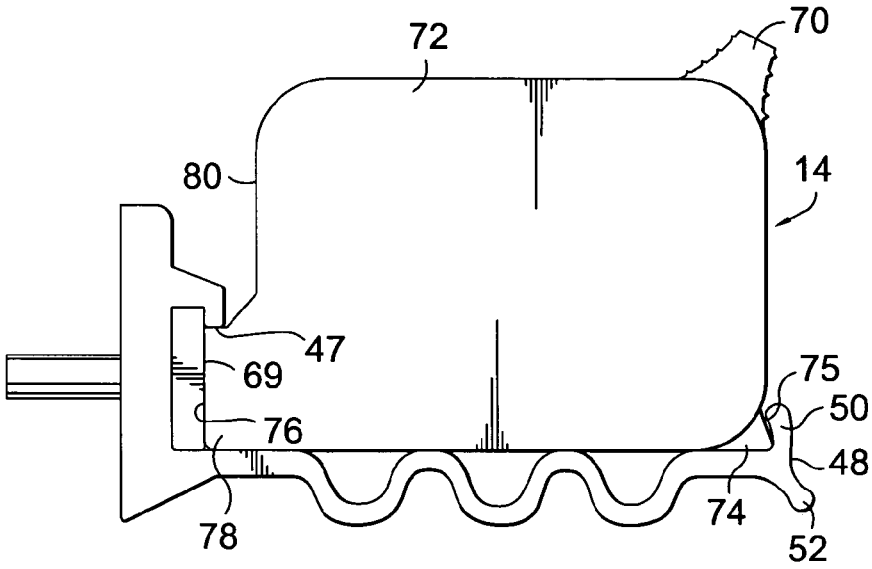
FIG. 4 is a side view of the clip and rubber gasket of the present invention with a cartridge secured therein.
Figure 5:
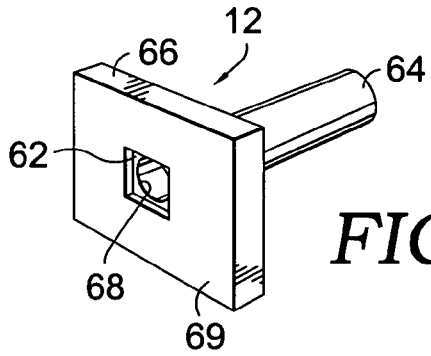
FIG. 5 shows the rubber gasket of the present invention.
Figure 6:
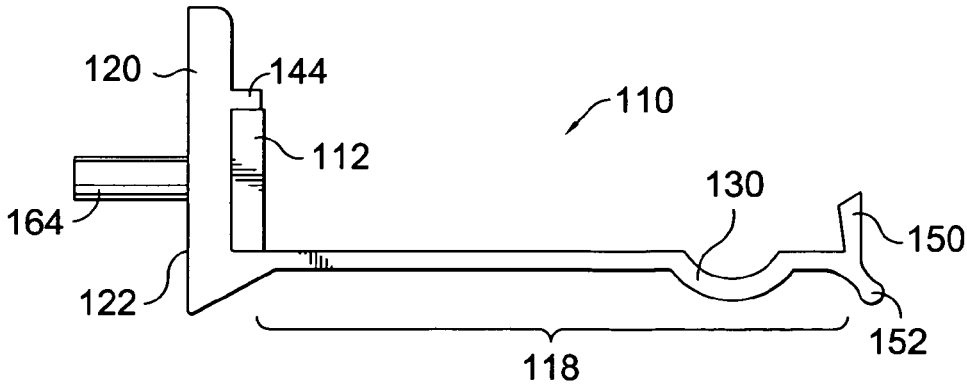
FIG. 6. PRIOR ART
FIG. 6 shows a prior art clip design.

A typical inkjet cartridge 14 may be seen in FIG. 4. Cartridge 14 comprises numerous components. First, this type of cartridge typically includes a thumb tab 70. The manufacturers of inkjet printers typically include these types of thumb tabs on their cartridges in order that the customer may grip them and use them for leverage to pry the cartridge into and out of the printer. Cartridges like the one shown in FIG. 4 typically include an ink reservoir, which is disposed in a housing 72. The reservoir (not shown) usually comprises a sponge or container within housing 72. One skilled in the art will know this typical arrangement. Cartridges typically also include a lock receiving cap at the bottom of the cartridge opposite the printhead. This will be used to secure cartridge 14 within clip 10 in a manner using mechanism 48. A catch 74 is also included on numerous types of cartridges.

On the opposite side of cartridge 14 is a printhead. Printheads have a plurality of ports. Printhead 76 is typically included on an outcropping 78 which brings it forward from a front face 80 of the cartridge.

Numerous types of commercially available cartridges comprise this same configuration. For example, the cartridge depicted in FIG. 4 is an HP 51645a (HP 45). Though this particular cartridge is shown as being received by clip 10 in FIG. 4, the clip and gasket arrangement disclosed would work equally well with numerous other HP, as well as numerous other types of cartridges which will be evident to those skilled in the art.

On a forward surface 41 of upright member 16, a gasket retainer 43 exists. Gasket retainer 43 comprises an overhang portion 44 and a depending lock 46 which serves to lock gasket 12 in place.

We will now discuss the manner in which clip 10 and gasket 12 may be used to refill or purge a typical cartridge 14.

Figure 2:
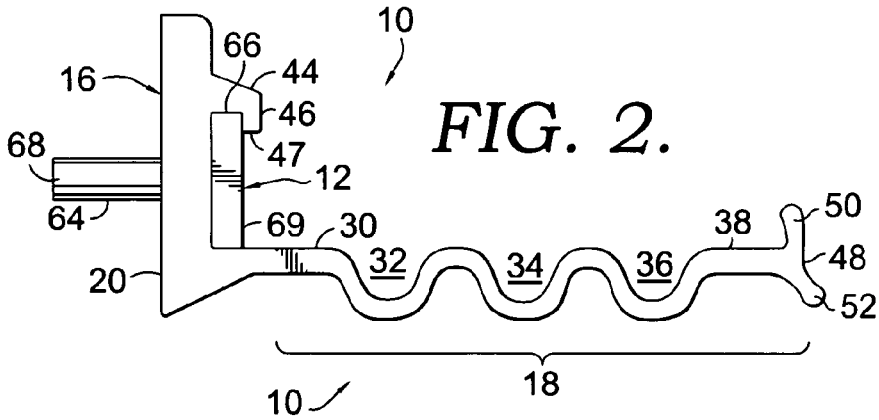
FIG. 2 is a side view of the clip and rubber gasket of the present invention.
Figure 3:
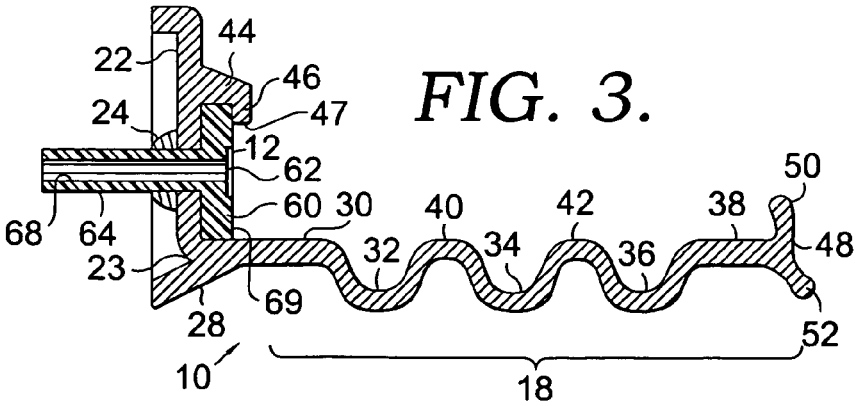
FIG. 3 is a cross-sectional view of the clip and the rubber gasket of the present invention.

The first step is to assemble gasket 12 into clip 10. This is done by inserting stem 64 through stem receiving hole 26 until its tip protrudes out the backside 20 of upright 16. As gasket 12 is moved towards a forward surface 41 of upright member 16, an upper portion 66 will come into engagement with depending lock 46. At this point it will be necessary to fold the upper edge 66 of gasket 12 underneath the depending member 46 of overhang 44 and allow upper portion 66 to engage an underside 45 of overhang 44. This will cause member 12 to be held within clip 10 as can be seen in FIGS. 2–4. Once gasket 12 has been installed into clip 10 as described, the user may then begin the refilling or purging process.

In doing so, the user should select a particular cartridge (e.g., cartridge 14) to be filled or purged. In the case of refilling, this will be an empty cartridge. The cartridge is then inserted into clip 10 in a manner shown in FIG. 4.

This is done by first pressing the printhead 76 against a forward surface 69 of gasket 12. When this is done, a cartridge bearing surface 47 will press down on outcropping 78. This holds printhead 76 securely in position against the face of gasket 12. Bearing surface 47 is configured such that the outcropping 78 of cartridge 14 will fit snuggly underneath it. It is also configured such that the ports in the printhead of cartridge 14 will be fluidly communicable with a square aperture 62. Aperture 62 has a square cross section.

Once printhead 76 of cartridge 14 has been pressed against gasket 12, the other side of cartridge 14 can easily be then snapped into the clip. This is done using the thumb-activated release mechanism 48. The user simply pushes down on thumb tab 70, or some other part of the cartridge, and pushing it downward. This causes locking portion 50 to initially be pushed outward. This allows the lock receiving catch 74 to move downward until it abuts the upper surface of outer most plateau 38. After catch 74 engages the upper surface of plateau 38, locking portion 50 will have snapped back into place. There, it holds down catch 74 by bearing down against a sloped surface 75. Thus, mechanism 48 along with bearing surface 47 serve to hold cartridge 14 down against laterally extending portion 18.

Once cartridge 14 is snapped into the clip using mechanism 48, an ink conducting circuit will have been created which may be used to fluidly communicate the cartridge's printhead with a syringe or other pressure controlling device. This circuit begins at the printhead with an aperture 62. Aperture 62 feeds into a conduit 68 (see FIG. 5) which extends through, and out of stem 68. Conduit 68 through stem 64 is inserted onto the stem of a typical syringe (not pictured).

Most syringes have a stem through which fluid is either retracted or expelled and which thereon a variety of needles and/or other devices are attachable. The inside of conduit 68 is sized to receive such a stem. And because stem 64 is made of rubber, it holds the stem of the syringe securely within it. Once the stem of the syringe is inserted, fluid may be pushed in through conduit 68, or retracted out through conduit 68 as desired.

Though a syringe has been used as the pressure controlling device in this preferred embodiment, other means of introducing and retracting fluid will be obvious skilled in the art and could be used instead. For example, pumps and squeeze bottles had been used for these purposes before.

Now that cartridge 14 has been snapped into place and is firmly held within clip 10, it is time to either refill cartridge 14 through the ports in the printhead 76, or alternatively to suction out the ports in printhead 76 to purge the cartridge.

The refilling process is performed as follows. First, the syringe or other fluid introduction/withdrawal device is fluidly connected to stem 64 as has already been described above. Assuming this device to be a syringe, again, the stem of the syringe (not pictured) will be held within stem 64 of gasket 12 so that this fluid connection is made. This allows fluid to be either injected into cartridge 14 under pressure from an ink filled syringe, or drawn out of the cartridge by suction provided by a syringe.

When refilling the syringe, the ink will be drawn from the syringe through the ports into cartridge 14. When this is done ink will begin to fill the ink reservoir inside housing 72. Depending on the cartridge, pressure must often times be alleviated from cartridge 14 through a hole or other means to exhaust air. This technique is known in the art. This hole will have to be later plugged (also in a manner known to those skilled in the art of refilling such cartridges). Once the cartridge is filled to the desired level, this hole (not pictured) must be plugged up and the cartridges were ready for removal from the clip 10. Before removing the cartridge 14, it is normally advisable, though not entirely necessary, to remove the syringe or other pump device from stem 64 of gasket 12.

Once this device has been removed, if desired, cartridge 14 can then be easily removed from clip 10 by pulling downwardly and rearwardly on depending trigger 52. This releases catch 74 from mechanism 48. Once catch 74 has been snapped out of mechanism 48, the cartridge 14, cartridge 14 may be easily lifted up and out of the clip.

Now that cartridge 14 is free of clip 10, it is ready to be installed into a printer for reuse, or stored if desired. If cartridge 14 is to be stored, it is advisable that printhead 76 be covered with tape or some other means to prevent leakage.

If clip 10 along with gasket 12 are to be used to purge the printhead of a cartridge, the process is the same except that an empty syringe will be used. This syringe will be attached to stem 64. Instead of injecting ink, the syringe will be used to withdraw ink from the cartridge. This process may be necessary when the ports in printhead 76 have become occluded or blocked by impurities due to wear and tear or for other reasons. Once the plunger in the syringe (not pictured) is withdrawn, fluid will be drawn out of the cartridge through the ports in the printhead 76 (not pictured). The ink then moves through aperture 62, out through duct 68, and then into the syringe.

Fluid should be extracted until at least some ink is visible coming into the syringe. Once the cartridge has been purged, it may then be removed from the clip in the same manner described for the refilling process above. That is, trigger 52 is pulled downward and rearward to release catch 74 and the cartridge may be pulled up and away from the device.

The pending lock 46 performs several important functions. First, its bearing surface 47 locks the printhead vertically in place at the appropriate position on the face 69 of gasket 12. This makes sure that the ports in the printhead 76 are line up with the aperture 62 is wider than conduit 68. Here, in FIG. 3, though not specifically pictured, this aperture has a square cross-section. It could however have an oval or other shaped cross-sectional configuration. It is important that aperture 62 is properly positioned, because it surrounds the printhead ports, and allows the egress and insertion of ink through them.

A second important function of lock 46 is that it clamps gasket 12 securely against the upright portion 16. In addition to its securing advantages, it also provides better matching up of the printhead with aperture 62 by holding the mat in place.

Thus, there has been shown and described a clip for securing an inkjet cartridge such that it may be purged (or refilled). Many changes, modifications, variations, and other uses and applications of the subject invention will, however, become apparent to those skilled in the art after considering this specification together with the accompanying figures and claims.

The invention claimed is:

1. A device for securing an inkjet cartridge, said device having a laterally extending member and an upright member, said upright member adapted to receive a stem from a gasket there through, said stem at one end connecting to a mat of said gasket, a first side of said mat being pressed against an inside face of said upright member, a fluid transmission circuit defined by both a conduit, said conduit being defied by said stem and a portion of said mat along with an aperture defined within said mat, said device further comprising a releasable latching mechanism at a distal end of said laterally extending member, said latching mechanism serving to lock down an outer end of an inkjet cartridge, the improvement in said device comprising:

an overhang portion on said upright member, said overhang portion having an underside surface which engages an upper surface of a mat, and said downwardly depending portion also having a inside surface for engaging a surface on a second side of said mat proximate an upper portion of said mat, said downwardly depending portion being adapted such that said upper portion of said mat is able to be folded under and inserted into said a secured position inside said downwardly depending portion; and said overhang portion having said downwardly depending portion with a bottom surface which engages an outcropped portion of said cartridge from above to hold down said outcropped portion.

2. The device of claim 1 wherein said cross section of said laterally extending member comprises a wave.

3. The device of claim 2 wherein said cross section of said laterally extending member comprises two waves.

4. The device of claim 3 wherein said cross section of said laterally extending member comprises an inner plateau followed by a first valley followed by a first crest followed by a second valley followed by a second crest followed by a third valley followed by an outer plateau.

5. A device for securing an inkjet cartridge comprising:

a laterally extending member having a double-waved cross section;

an upright member; said upright member adapted to receive a stem from a gasket there through, said stem at one end connecting to a mat of said gasket, said mat being pressed against an inside face of said upright member, a fluid transmission circuit defined by both a conduit, said conduit being defined by said stem and a portion of said mat along with an aperture defined within said mat; and a releasable latching mechanism at a distal end of said laterally extending member, said latching mechanism serving to lock down an outer end of an inkjet cartridge; and a cross section of said laterally extending member.

6. The device of claim 5 wherein said cross section of said laterally extending member comprises an inner plateau followed by a first valley followed by a first crest followed by a second valley followed by a second crest followed by a third valley followed by an outer plateau.

* * * * *